US007465184B2

(12) United States Patent
Scherer et al.

(10) Patent No.: US 7,465,184 B2
(45) **Date of Patent: *Dec. 16, 2008**

(54) CONNECTOR ASSEMBLY INCLUDING INSULATION DISPLACEMENT ELEMENTS CONFIGURED FOR ATTACHMENT TO A PRINTED CIRCUIT

(75) Inventors: Richard J. Scherer, Austin, TX (US); Michael L. Black, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/770,467

(22) Filed: Jun. 28, 2007

(65) Prior Publication Data

US 2008/0020626 A1 Jan. 24, 2008

Related U.S. Application Data

(60) Provisional application No. 60/820,187, filed on Jul. 24, 2006.

(51) Int. Cl.
*H01R 4/24* (2006.01)

(52) U.S. Cl. ..... 439/408; 439/409

(58) Field of Classification Search ..... 439/397, 439/404, 408, 409, 410, 417
See application file for complete search history.

(56) References Cited

U.S. PATENT DOCUMENTS 4,995,829 A * 2/1991 Geib et al. ..... 439/409
5,269,700 A * 12/1993 Mitra ..... 439/395
5,281,164 A * 1/1994 Gan ..... 439/409
5,785,548 A * 7/1998 Capper et al. ..... 439/409
5,939,672 A * 8/1999 Tang ..... 174/50.5
6,074,238 A 6/2000 DeRoss et al.
6,254,421 B1 * 7/2001 Denovich et al. ..... 439/409
6,406,324 B1 * 6/2002 Duesterhoeft et al. ..... 439/409
7,101,216 B2 * 9/2006 Fasce et al. ..... 439/402
7,112,079 B2 9/2006 Miura et al.
7,165,983 B1 * 1/2007 Fasce et al. ..... 439/136
7,249,981 B2 * 7/2007 Chen ..... 439/751
2006/0057883 A1 3/2006 Fasce et al.
2006/0057884 A1 3/2006 Fasce et al.
2006/0089040 A1 4/2006 Pratt
2006/0160404 A1 7/2006 Alarcon et al.

FOREIGN PATENT DOCUMENTS

JP 08273708 10/1996

* cited by examiner

*Primary Examiner*—Thanh-Tam T Le
(74) *Attorney, Agent, or Firm*—Janet A. Kling; Melanie G. Gover

(57) ABSTRACT

An electrical connector for terminating electrical conductors includes a housing and a cap mounted to the housing. The housing includes a first housing section extending between a front wall and a base, a first wire groove formed through the front wall, and an insulation displacement connector (IDC) element disposed in the first housing section and configured for attachment to a printed circuit. The cap includes a pivot portion pivotally mounted to the housing and a cover portion extending from the pivot portion, where the pivot portion defines a wire receiving recess. In this regard, the cap is rotatable between an open position in which the first recess is linearly aligned with the first wire groove, and a closed position in which the cover portion is coupled to the front wall and the pivot portion is offset from the base to define a wire cavity.

9 Claims, 9 Drawing Sheets

CONNECTOR ASSEMBLY INCLUDING INSULATION DISPLACEMENT ELEMENTS CONFIGURED FOR ATTACHMENT TO A PRINTED CIRCUIT

REFERENCE TO CROSS-RELATED APPLICATIONS

The present application claims priority to U.S. Provisional Patent Application 60/820,187, filed Jul. 24, 2006.

FIELD

The present invention relates to insulation displacement connectors, and more particularly, to a connector assembly for housing at least one insulation displacement element that is configured for attachment to a printed circuit.

BACKGROUND

In a telecommunications context, for example, connector blocks are connected to cables that feed subscribers while other connector blocks are connected to cables fed from the central office. Jumper wires are inserted to complete the electrical circuit when making the electrical connection between the subscriber block and the central office block. Ideally, the jumper wires can be connected, disconnected, and reconnected as dictated by the consumer's needs.

An insulation displacement connector (IDC) element is often used to make the electrical connection to a wire or electrical conductor, including in telecommunications applications. The IDC element displaces the insulation from a portion of the electrical conductor when the electrical conductor is inserted into a slot within the IDC element. In this manner, the IDC element electrically connects to the electrical conductor. Once the electrical conductor is inserted within the slot and the insulation displaced, electrical contact is made between the conductive surface of the IDC element and the conductive core of the electrical conductor.

Typically the IDC element is housed in an insulated housing. Often, the housing has a cap or other moveable member that is movable to press the electrical conductor into contact with the IDC element. When inserting the electrical conductor in the housing, the cap closes and the user is unable to visually verify that the electrical conductor has made a proper connection with the IDC element. The user is thus unable be sure whether an effective connection has been made between the electrical conductor and the IDC element.

In addition, inserting the electrical conductor into the IDC element slot often requires a significant force, which may require the use of special tools or devices. In this regard, connecting multiple wires/conductors into the IDC element slot necessitates the use of additional force, which can fatigue the worker during the installation. In particular, closing the cap to insert the electrical conductor(s) into the IDC element slot may require a significant force, and over multiple such insertions has the potential to strain the user's fingers or hand.

SUMMARY

In at least one embodiment of the present invention, an electrical connector for terminating electrical conductors includes a housing and a cap mounted to the housing. The housing includes a front wall spaced apart from a base, a first housing section extending between the front wall and the base, a first wire groove formed through the front wall, and an insulation displacement connector (IDC) element disposed in the first housing section between the first wire groove and the base and configured for attachment to a printed circuit. The cap includes a pivot portion pivotally mounted to the housing and a cover portion extending from the pivot portion, where the pivot portion defines a first wire receiving recess that extends between an interior surface and an exterior surface of the cap. In this regard, the cap is rotatable between an open position in which the first wire receiving recess is linearly aligned with the first wire groove, and a closed position in which the cover portion is coupled to the front wall and the pivot portion is offset from the base to define a wire cavity between the pivot portion and the base.

While the above-identified figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the spirit and scope of the principals of this invention. The figures may not be drawn to scale. Like reference numbers have been used throughout the figures to denote like parts.

DETAILED DESCRIPTION

Figure 1:
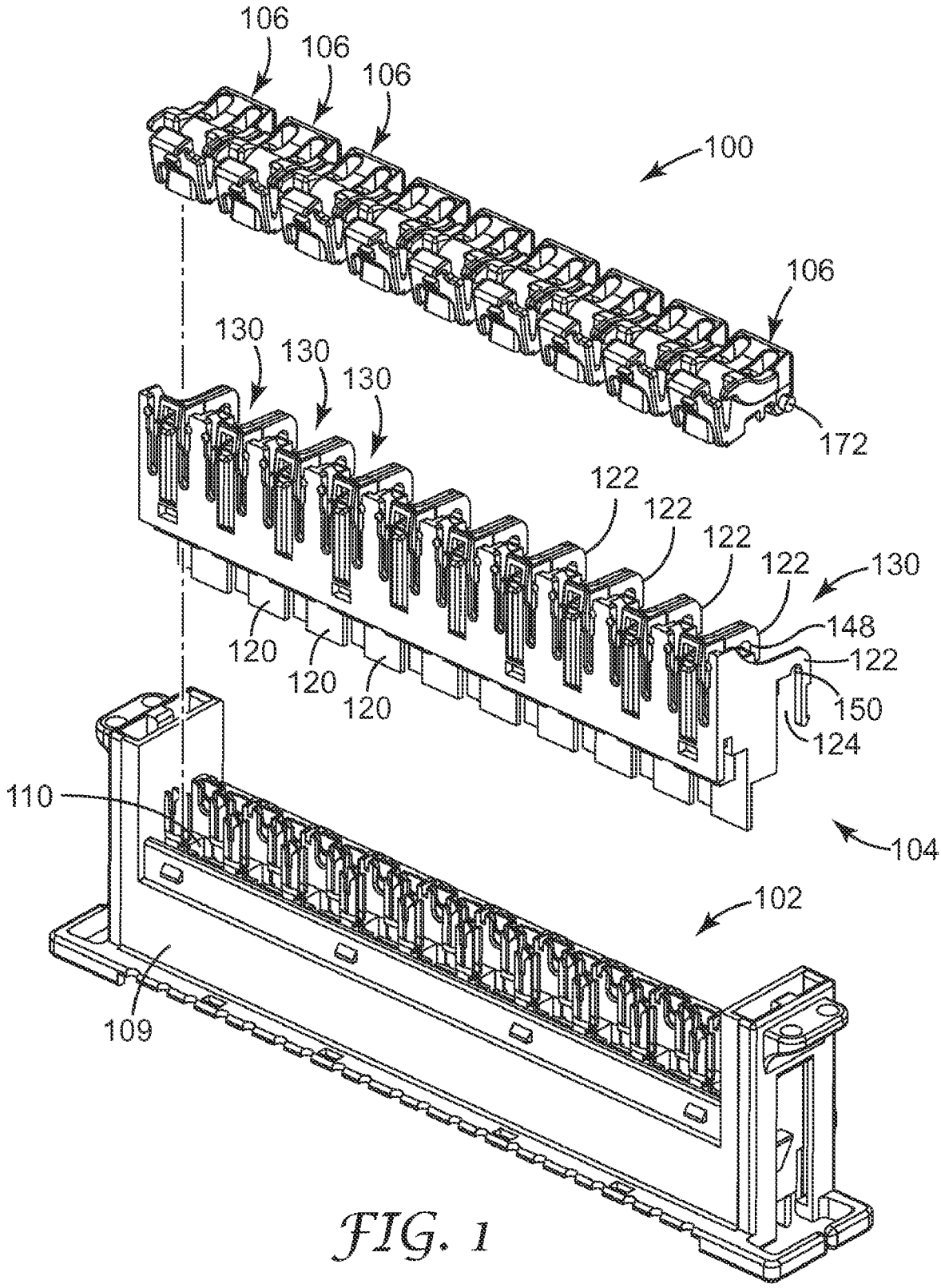
FIG. 1 illustrates an exploded perspective view of a connector assembly suited for electrical connection to a printed circuit according to one embodiment of the present invention.
Figure 11:
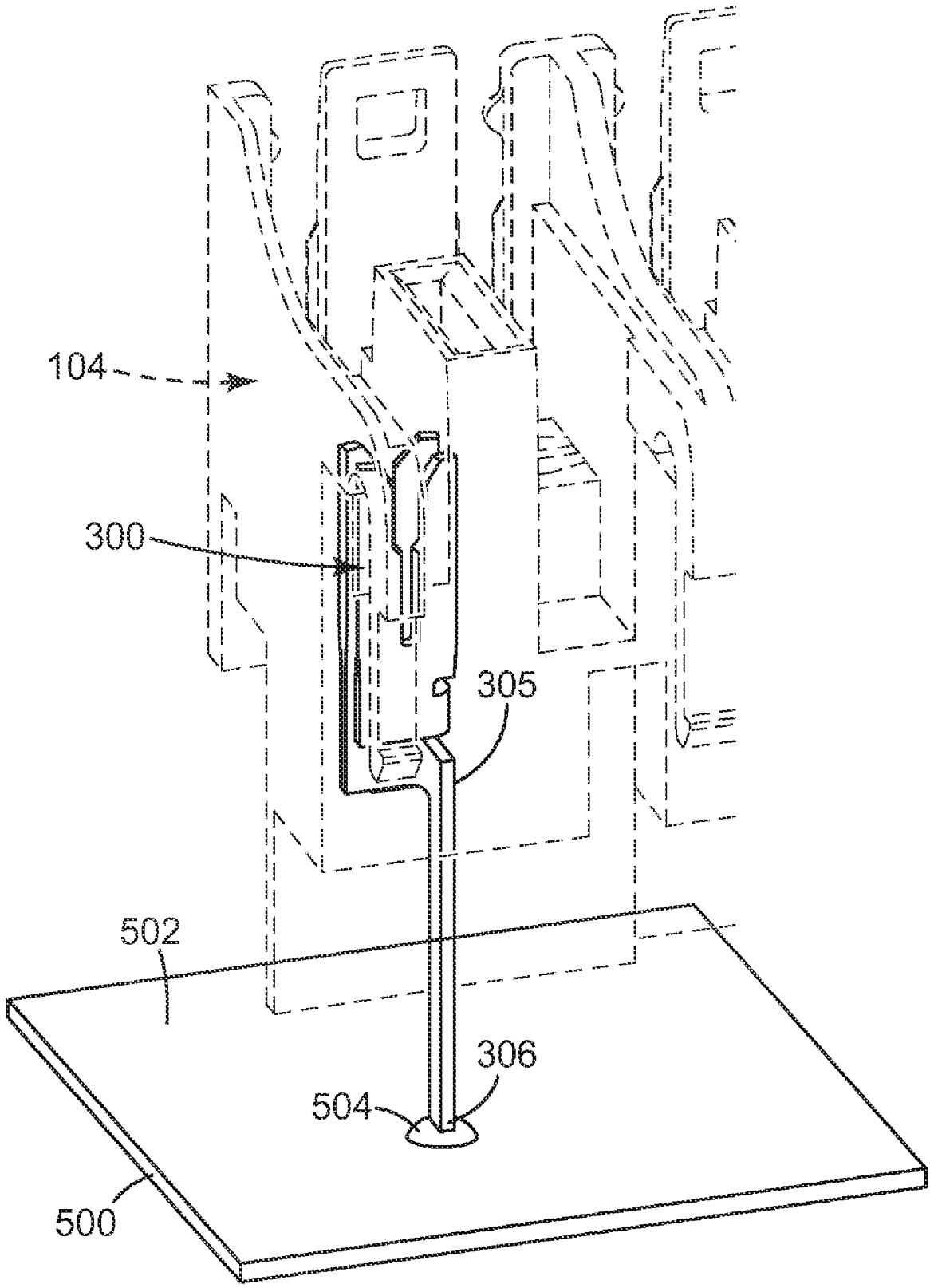
FIG. 11 illustrates a perspective view through the connector assembly of FIG. 1 (shown in phantom) showing an insulation displacement element soldered to a printed circuit according to one embodiment of the present invention.
Figure 12:
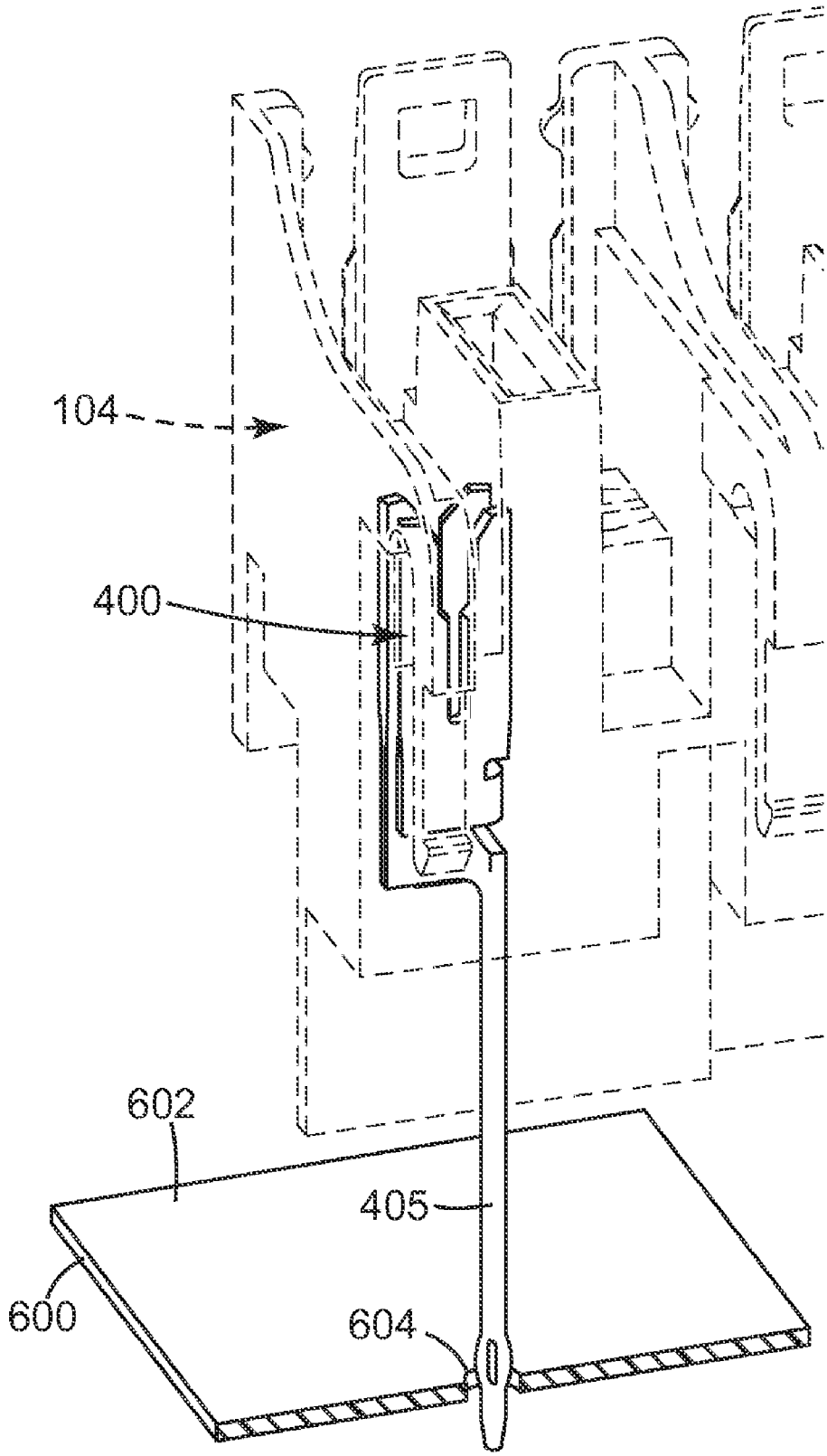
FIG. 12 illustrates a perspective view through the connector assembly of FIG. 1 (shown in phantom) showing another insulation displacement element press fitted into a printed circuit according to one embodiment of the present invention.

FIG. 1 illustrates an exploded perspective view of a connector assembly 100 suited for electrical connection to a printed circuit according to one embodiment of the present invention. The connector assembly 100 includes a base unit 102 configured for mounting to a printed circuit (as best illustrated in FIGS. 11-12), a connector unit 104, and a plurality of caps 106 suited for coupling to the connector unit 104. To assemble the connector assembly 100, the caps 106 are inserted between lock projections 122 projecting from a rear side of the connector unit 104, and the connector unit 104 is placed over and slid into the base unit 102. In this regard, the base unit 102 is configured for mounting to one of a variety of printed circuits, such as a printed circuit board, or other suitable printed circuit assemblies.

The base unit 102 includes an insulated housing 109 with a series of receiving slots 110 sized for receiving portions of the connector unit 104. Lock slots on a rear side of the base unit 102 receive lock projections 122 of the connector unit 104 to lock the connector unit 104 to the base unit 102.

Figure 8A:
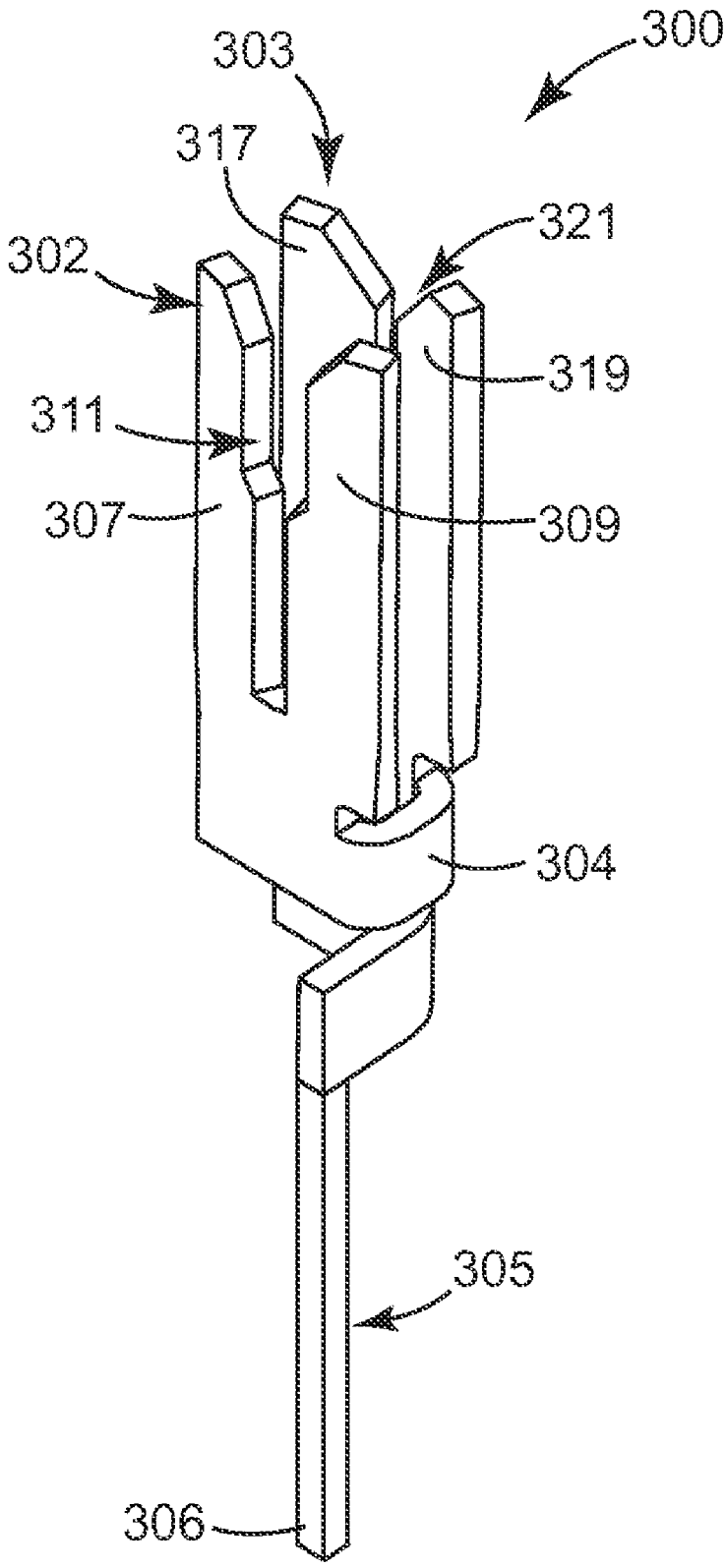
FIG. 8A illustrates a perspective view of an insulation displacement element according to one embodiment of the present invention.
Figure 8B:
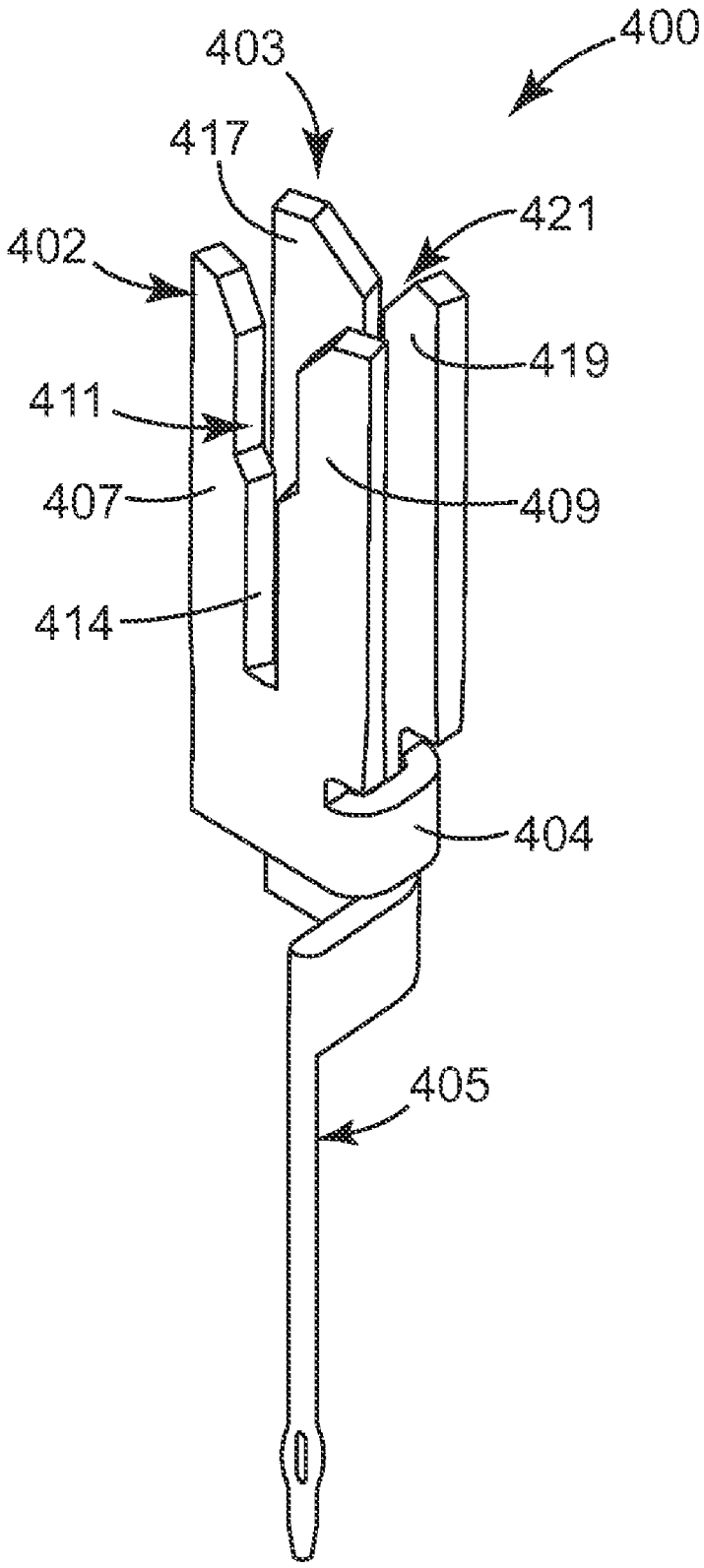
FIG. 8B illustrates a perspective view of an insulation displacement element according to another embodiment of the present invention.

Located within the connector unit 104 are a plurality of electrical elements 300 or 400 (FIGS. 8A and 8B, respectively). Each electrical element 300/400 is in the form of an IDC element, and is adapted to make electrical contact with a printed circuit, as described below.

The connector unit 104 includes an insulated housing 130 and a series of alignment projections 120 for connection into the receiving slots 110 of the base unit 102. The lock projections 122 project outwardly and downwardly from the rear side of the connector unit 104 and lock within the lock slots on the rear side of the base unit 102 (not shown) to lock the connector unit 104 to the base unit 102.

Each cap 106 is independently pivotally mounted onto the connector unit 104, relative to a respective housing 130. Each cap 106 includes a first pivot projection 170 and a second coaxial pivot projection 172 (FIG. 3) opposite the first pivot projection 170. The pivot projections 170, 172 enter and engage with the connector unit 104 through a gap 124 created between adjacent lock projections 122. For assembly, the pivot projections 170, 172 of the cap 106 are first inserted within the gap 124 and connected to the connector unit 104 prior to the connector unit 104 being attached to the base unit 102. Once the connector unit 104 is attached and locked within the base unit 102, the first and second pivot projections 170, 172 of the cap 106 are secured within hinge slots 148, 150, respectively, on adjacent lock projections 122 to prevent the cap 106 from being removed. In this regard, the pivot projections 170, 172 allow for pivoting movement of the cap 106 relative to the connector unit 104, within the hinge slots 148, 150.

Each connector assembly 100 is a self-contained unit, insulated from the next adjacent assembly 100. The connector assembly 100 may include any number of housings 130, base units 102, and caps 106. Each housing 130, base unit 102 and cap 106 form an assembly that is adapted to receive at least one pair of electrical conductors, as explained below. Because the connector assembly 100 may include any number of housings 130 and caps 106, there can be any number of paired electrical conductors entering and exiting the housings 130.

The connector assembly 100 may be constructed, for example, of an engineering plastic such as: a polybutylene terephthalate (PBT) polymer available under the trade name VALOX 325 from GE Plastics of Pittsfield, Mass.; a polycarbonate resin, flame retardant, 10% glass fiber reinforced grade available under the trade name LEXAN 500R from GE Plastics of Pittsfield, Mass.; a polycarbonate resin, flame retardant, 10% glass fiber reinforced grade available under the trade name MACKROLON 9415 from Bayer Plastics Division of Pittsburgh, Pa.; or a polycarbonate resin, flame retardant, 20% glass fiber reinforced grade available under the trade name MACKROLON 9425 from Bayer Plastics Division of Pittsburgh, Pa. Other suitable engineering plastics are also acceptable.

The caps 106 may be constructed, for example, of an engineering plastic such as: a polyetherimide resin available under the trade name ULTEM 1100 from GE Plastics of Pittsfield, Mass.; a polybutylene terephthalate (PBT) resin flame retardant, 30% glass fiber reinforced available under the trade name VALOX 420 SEO from GE Plastics of Pittsfield, Mass.; a polyacrylamide resin, flame retardant, 30% glass fiber reinforced grade available under the trade name IXEF 1501 from Solvay Advanced Polymers, LLC of Alpharetta, Ga.; or a polyacrylamide resin, flame retardant, 50% glass fiber reinforced grade available under the trade name IXEF 1521 from Solvay Advanced Polymers, LLC of Alpharetta, Ga. Other suitable engineering plastics are also acceptable.

Figure 2:
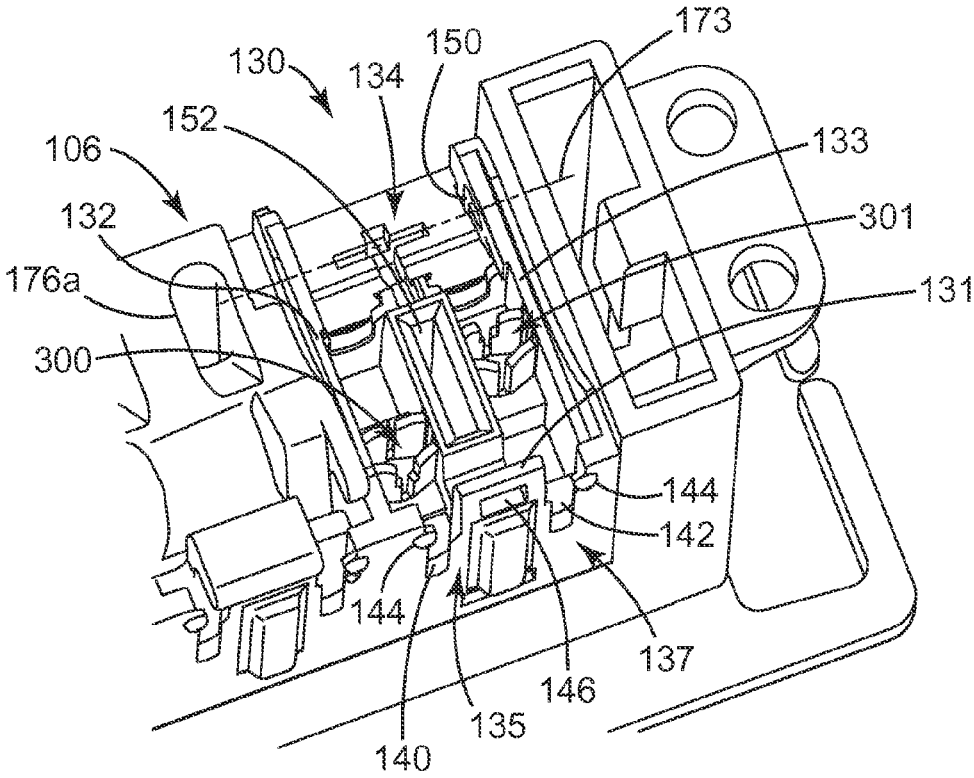
FIG. 2 illustrates an assembled perspective view of a portion of the connector assembly shown in FIG. 1 with one of a plurality of pivoting caps removed for clarity of illustration.

FIG. 2 illustrates an assembled perspective view of a portion of the connector assembly 100 (FIG. 1) with one of a plurality of pivoting caps 106 removed for clarity of illustration. Electrical conductors (i.e., wires), which would otherwise be in the housing 130 when fully assembled for operation, have been omitted to better show the internal configuration and components of the housing 130.

Each housing 130 includes a front wall 131, a first side wall 132, a second side wall 133, and a base 134. The housing 130 is formed to have a first section 135 and a second section 137. Separating the first section 135 from the second section 137 is an optional test probe slot 152.

Along the front wall 131 is a first wire groove 140 and a second wire groove 142, which allow entry of the electrical conductors (i.e., wires) into the housing 130. Wire retainer projections 144 extend laterally into the grooves 140 and 142 to resiliently hold the electrical conductors within the first wire groove 140 and second wire groove 142, and prevent the electrical conductors from moving out of the open ends of the grooves 140, 142. A latch opening 146 is also disposed on the front wall 131, which is capable of receiving a latch projection 190 (FIG. 3) on the cap 106 to lock the cap 106 to the front wall 131 of the housing 130 and prevent the cap 106 from inadvertently opening.

Along the first side wall 132 is a first hinge slot 148 (FIG. 1), and along the second side wall 133 is a second hinge slot 150, where each hinge slot 148, 150 is defined by the lock projections 122 (FIG. 1). The hinge slots 148, 150 pivotally receive the pivot projections 170, 172 extending laterally from the cap 106 to allow the cap 106 to pivot along a pivot axis 173.

In one embodiment, the base 134 of the housing 130 includes the test probe slot 152 that essentially separates the first section 135 of the housing 130 from the second section 137 of the housing 130. In another embodiment, a test probe slot is provided that is oriented transverse relative to the housing 130 such that the test probe slot bridges between, for example, the first side wall 132 and the second side wall 133. In any regard, the test probe slot 152 may be divided into two portions with the first allowing for testing of the electrical connections within the first section 135 of the housing 130, and the second allowing for testing of the electrical connections within the second section 137 of the housing 130. Test probes as are known in the art can be inserted into the test probe slot 152.

Extending from the base 134 of the first section 135 of the housing 130 is a first IDC element 300, and extending from the base 134 of the second section 137 of the housing 130 is a second similar IDC element 301. Each IDC element 300, 301 is conductive and capable of displacing the insulation from electrical conductors to electrically couple the conductive cores of the electrical conductors to the IDC elements. Choosing appropriate materials and optional plating is well within the skill of the art. In one exemplary embodiment, the IDC elements 300, 301 and/or 400 (FIG. 8B) may be constructed of phosphor bronze alloy C51000 per ASTM B103/103M-98e2 with reflowed matte tin plating of 0.000150-0.000300 inches thick, per ASTM B545-97(2004)e2 and electrodeposited nickel underplating, 0.000050 inches thick minimum, per SAE-AMS-QQ-N-290 (July 2000).

Figure 3:
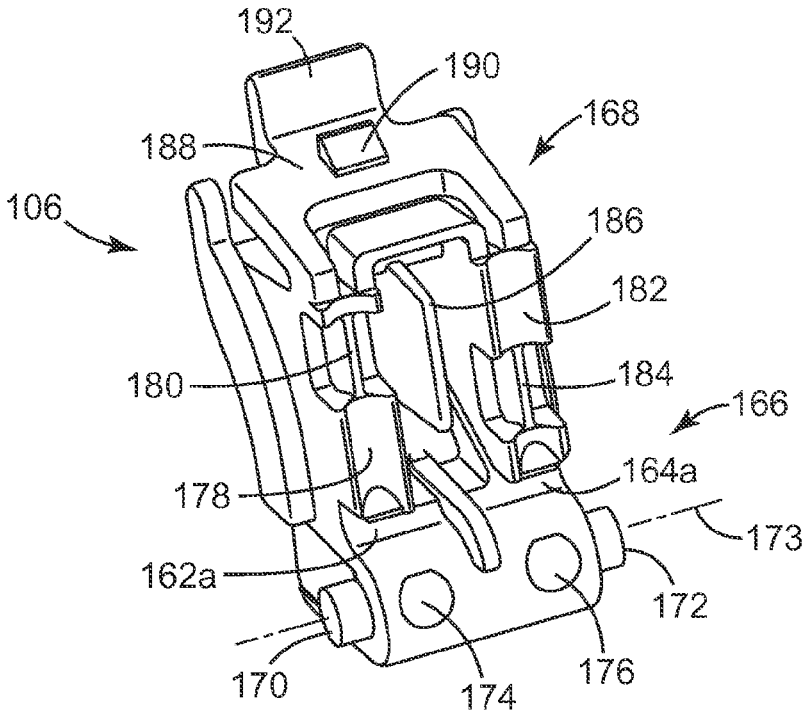
FIG. 3 illustrates a perspective view of an underside of a cap as removed from the connector assembly shown in FIG. 2.

FIG. 3 illustrates a perspective view of an underside of the cap 106 as removed from the connector assembly 100 (FIG. 1). The cap 106 includes a pivot portion 166 and a cover portion 168. Extending laterally from the pivot portion 166 is the first pivot projection 170 and second pivot projection 172. The pivot projections 170, 172 engage with the hinge slots 148, 150 of the side walls 132, 133 of the housing 130 to secure the cap 106 to the housing 130 while allowing for pivoting movement of the cap 106 along the pivot axis 173.

Extending into the pivot portion 166 is a first recess 174 and second recess 176 sized to receive wires/electrical conductors. In one embodiment, the recesses 174, 176 extend through the entire pivot portion 166 of the cap 106. The first recess 174 is aligned with the first section 135 of the housing 130, and the second recess 176 is aligned with the second section 137 of the housing 130. Each recess 174, 176 receives electrical conductors passing through the housing 130. Although the first recess 174 and second recess 176 are shown as parallel recesses through the pivot portion 166, it is within the scope of the present invention that the first recess 174 and second recess 176 may not be parallel to one another.

The cover portion 168 of the cap 106 is moveable from an open position (FIGS. 4 and 5) to a closed position (FIG. 7) to cover the open top of the housing 130. Adjacent the pivot portion 166 of the cap is a first indent 162*a* and a second indent 164*a*. A first wire hugger 178 and a first wire stuffer 180 are located on the cover portion 168, adjacent the first section 135 of the housing 130. A second wire stuffer 184 and a second wire hugger 182 are located on the cover portion 168 adjacent the second section 137 of the housing 130.

When the cap 106 is closed, the underside of the cover portion 168 of the cap 106 engages the electrical conductor. The first wire hugger 178 and first wire stuffer 180 engage an upper exposed surface of the electrical conductor. Upon complete closure of the cap 106, the first wire stuffer 180 (being aligned with a first IDC element 300) follows and pushes the electrical conductor into the first IDC element 300 (FIG. 2). A similar closing occurs at the second IDC element 301. However, because the second IDC element 301 is closer to the pivot axis 173 (FIG. 2) of the pivot portion 166 of the cap 106, the second wire stuffer 184 is arranged on the cap 106 to accord with this orientation (i.e., the positions of the wire stuffers 180 and 184 are staggered radially relative to the pivot axis 173). The overall length of the wire stuffers 180,184 may be uniform or may be different from one another depending on the sequencing desired for pushing the electrical conductors into the IDC elements 300, 301. Extending through the center of the cover portion 168 is a test probe slot cap 186, which partially enters the test probe slot 152 (FIG. 2) when the cap 106 is closed.

The cap 106 provides a resilient latch 188, which is capable of flexing relative to the cover portion 168. When the cap 106 is closed, the resilient latch 188 flexes so that the latch projection 190 on the resilient latch 188 can enter the latch opening 146 on the front wall 131 of the housing 130. When the latch projection 190 is engaged with the latch opening 146, the cap 106 is secured to the housing 130 and will not open. To open the cap 106, a release lever 192 on the resilient latch 188 is pressed rearward to disengage the latch projection 190 from the latch opening 146. Then, the cap 106 can be pivoted open, as shown in FIG. 4, for access to the cavity within the housing 130 and electrical conductors and IDC elements therein.

Figure 4:
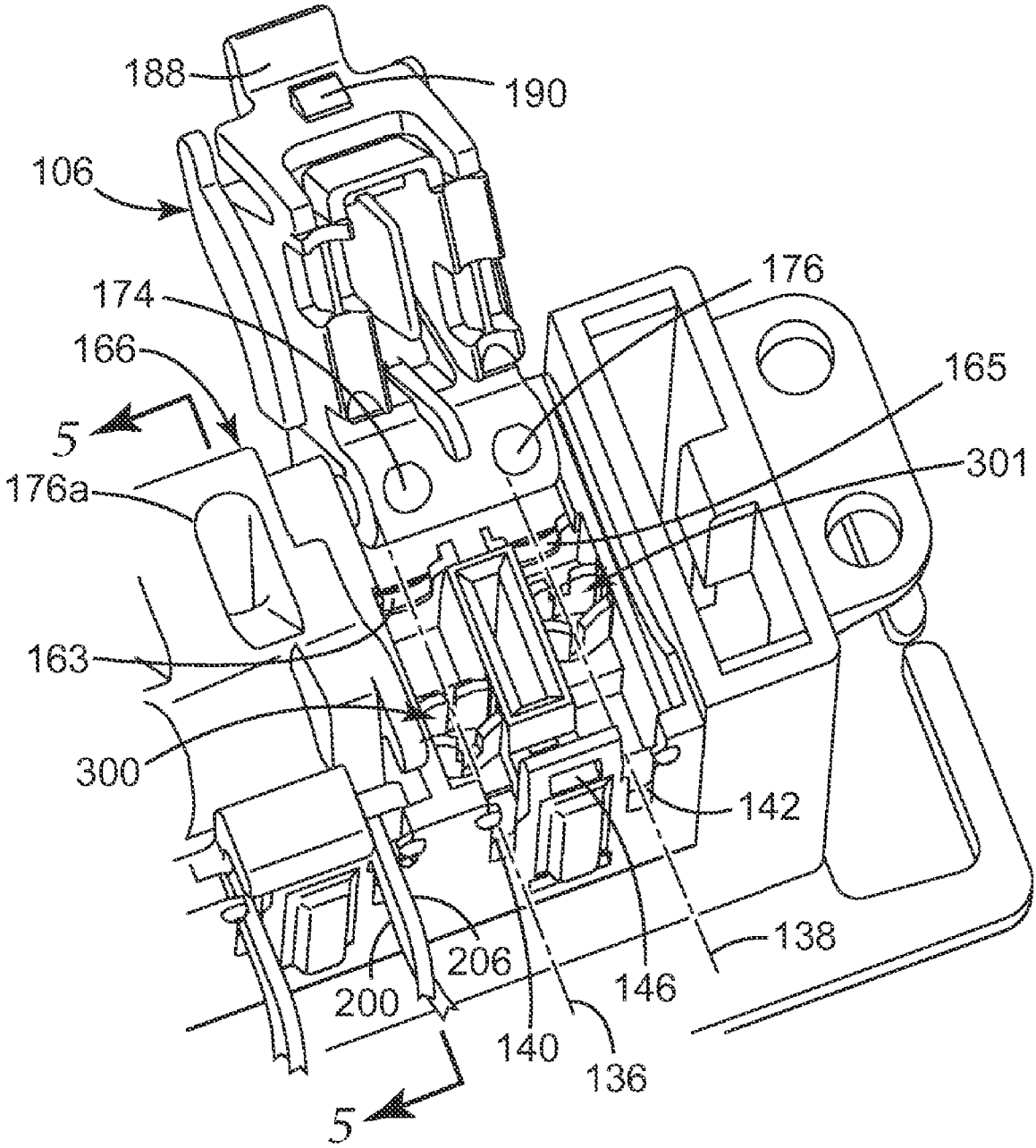
FIG. 4 illustrates a perspective view of a portion of the assembled connector assembly showing one of the caps in a pivoted open position relative to a housing according to one embodiment of the present invention.

FIG. 4 illustrates a perspective view of a portion of the assembled connector assembly 100 (FIG. 1) showing one of the caps 106 in a pivoted open position relative to the housing 130. Again, the electrical conductors have been omitted in FIG. 4 to show the internal configuration and components of the housing 130. However, a first electrical conductor 200 and a second electrical conductor 206 can be seen extending from an adjacent housing.

The first IDC element 300 is located at the base 134 of the first section 135 of the housing 130. A first support 163 with a generally U-shape is provided to support and cradle an electrical conductor when inserted into the housing 130. In particular, when the cap 106 is closed and pressing down on the electrical conductor, the first support 163 supports the electrical conductor within the first section 135 of the housing 130.

The second IDC element 301 is located at the base 134 of the second section 137 of the housing 130. A second support 165 with a generally U-shape is provided to support and cradle an electrical conductor when inserted into the housing 130. In particular, when the cap 106 is closed and pressing down on the electrical conductor, the second support 165 supports the electrical conductor within the second section 137 of the housing 130.

In one embodiment, the first IDC element 300 is arranged linearly relative to the first section 135 of the housing 130, and the second IDC element 301 is arranged linearly relative to the second section 137 of the housing 130. As can be seen, the first wire groove 140, first IDC element 300, first support 163, and first recess 174 in the cap 106 are generally linearly arranged along a first longitudinal axis 136 within the first section 135 of the housing 130. Within the second section 137 of the housing 130, the second wire groove 142, second IDC element 301, second support 165, and second recess 176 in the cap 106 are generally linearly arranged along a second longitudinal axis 138. Relative to the pivot axis 173 of the cap 106, the first IDC element 300 and the second IDC element 301 are off-set (i.e., radially staggered) from one another along their respective longitudinal axes 136, 138.

The second IDC element 301 is closer to the pivot portion 166 of the cap 106 than the first IDC element 300. This staggering of the first IDC element 300 and second IDC element 301 minimizes the force needed to be applied to the cap 106 to properly close the cap 106 and engage all electrical conductors in each IDC element, because the electrical conductors are not being forced into their respective IDC elements at the same time during closure. Instead, the electrical conductor for the IDC element closest to the pivot portion 166 of the cap 106 (second IDC element 301) is pressed into engagement first, and the electrical conductor at the IDC element farthest from the pivot portion 166 of the cap 106 (first IDC element 300) is pressed into engagement last.

Although the first IDC element 300 and the second IDC element 301 are shown staggered relative to the pivot axis 173, the first IDC element 300 and second IDC element 301 may be uniformly arranged within the housing 130. Further, the first IDC element 300 and the second IDC element 301 may have different heights relative to the base 134 of the housing 130 such that electrical conductors will first be inserted into the higher IDC element, and then into the lower IDC element. As mentioned above, the wire stuffers 180, 184 may also have different lengths. Sequencing the insertion of the electrical conductors into the IDC elements distributes the forces needed to close the cap 106 while making the proper connections.

The housing 130 includes a first section 135 and a second section 137 with essentially similar components on each section, although the housing 130 may include a single set of components like the wire groove, recess in the pivot portion, IDC element, support, etc.

In use, an electrical conductor, which includes a conductive core surrounded by an insulation layer, is inserted into the first section 135 of the housing 130 and into the first recess 174. A similar electrical conductor can likewise be inserted into the second section 137 and into the second recess 176. Although it is preferable to insert the electrical conductor into each section of the housing one at a time, electrical conductors may be inserted into each section of the housing 130 at the same time. Once in place, the cap 106 is closed to insert the electrical conductors into the slots of the IDC element.

Electrical conductors 200/206 are typically coupled to the connector assemblies 100 in the field. Accordingly, ease of use and achieving a high probability of effective electrical coupling of the components is important. The conditions of use and installation may be harsh, such as outdoors (i.e., unpredictable weather conditions), in underground cabinets (i.e., tight working quarters), and assembly may include the use of non-highly skilled labor. Thus, it is desired to simplify the process of connecting wires to the IDC element. The present invention achieves this end by providing an arrangement for aligning the wires, and for providing an operator with affirmative feedback that the alignment was correct (and thus a proper electrical coupling has been made) even after the cap has been closed and the alignment of components is no longer visible.

Figure 5:
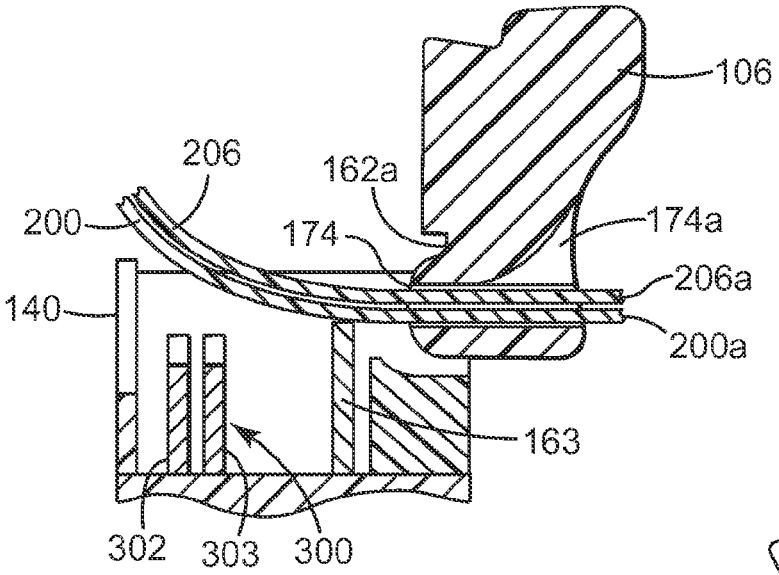
FIG. 5 illustrates a cross-sectional view taken through the connector assembly of FIG. 4 with a pair of wires inserted through a recess in the cap and the cap in a fully opened position relative to the housing.

FIG. 5 illustrates a cross-sectional view taken through the connector assembly 100 of FIG. 4. A pair of wires 200, 206 is inserted through the first recess 174 in the opened cap 106. In particular, the wires 200,206 extend through the first wire groove 140, are aligned over the first IDC element 300, and a distal end 200*a* of the wire 200 and a distal end 206*a* of the wire 206 exit the housing 130. The distal ends 200*a*, 206*a* are thus available as drop wires that are suitable for connection to other electrical devices/circuits.

Figure 6:
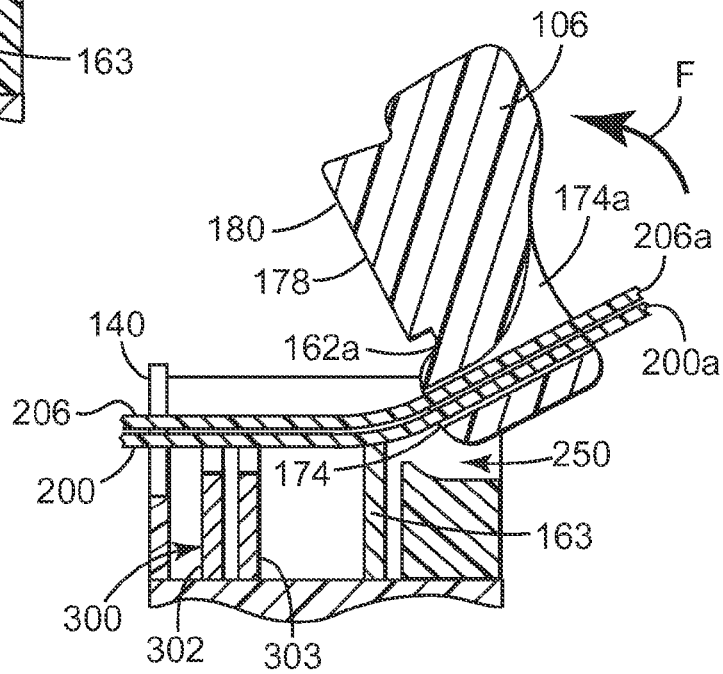
FIG. 6 illustrates the cross-sectional view of FIG. 5 with the cap in a partially closed position relative to the housing.

FIG. 6 illustrates the cross-sectional view of FIG. 5 with the cap 106 in a partially closed position relative to the housing 130. The cap 106 is in the process of being closed by application of force F on its upper surface. In this regard, for IDC elements 300, 301 having similarly sized contact openings, the force F is generally understood to be higher for increasing wire sizes. The wires 200, 206 pass through wire cavity 250, and ultimately out of the cap 106. To make the electrical connection between the wires 200, 206 and first IDC element 300, a user begins to close the cap 106 by application of force F. The surface of the cap 106 is curved so as to allow a user's finger or thumb to easily engage and ergonomically close the cap 106.

The first wire stuffer 180 and first wire hugger 178 approach an upper exposed surface of the wire 206 and begin to make contact therewith, and the continued force during closing of the cap 106 urges the wire 200 into contact with first support 163.

Figure 7:
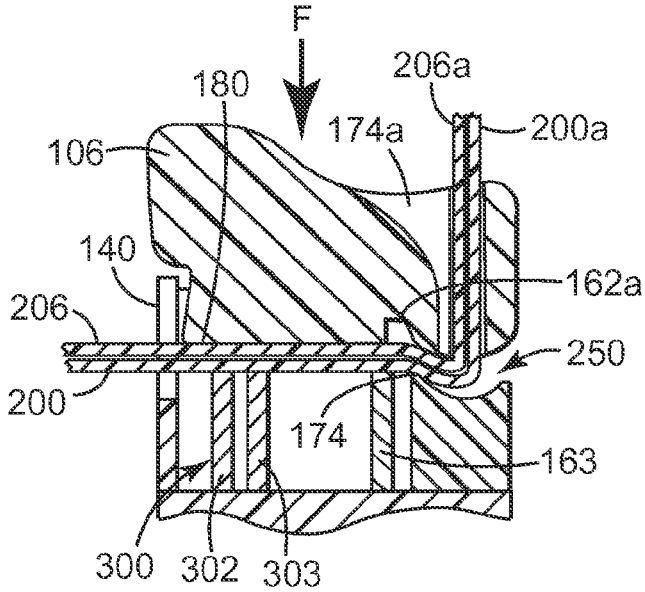
FIG. 7 illustrates a cross-sectional view taken through the connector assembly of FIG. 5 with the pair of wires retained in a wire cavity and projecting through the cap, with the cap in a fully closed position relative to the housing.
Figure 9:
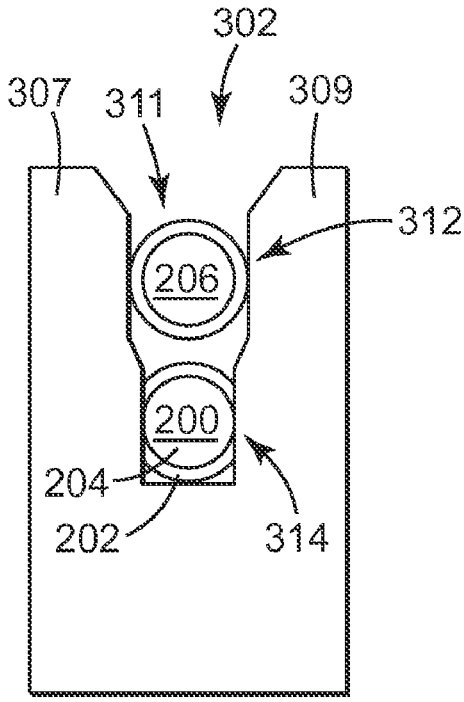
FIG. 9 illustrates a front view of a first contact of an insulation displacement element according to one embodiment of the present invention.
Figure 10:
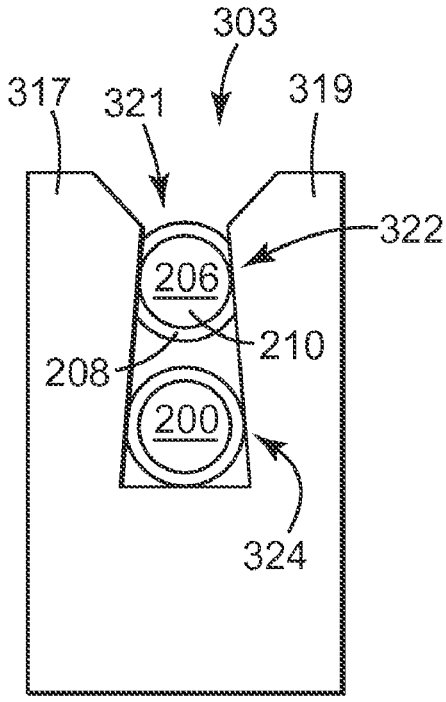
FIG. 10 illustrates a front view of a second contact of an insulation displacement element according to one embodiment of the present invention.

FIG. 7 illustrates a cross-sectional view taken through the connector assembly 100 of FIG. 4 with the pair of wires 200, 206 retained in the wire cavity 250 and projecting through the cap 106, with the cap 106 in a fully closed position relative to the housing 130. Each of the wires 200, 206 includes a conductive core 204 surrounded by an insulation sheath layer 202 (FIGS. 9 and 10). When the electrical conductor 200 begins to make contact with the first IDC element 300, the electrical conductor 200 enters the second insulation displacement slot 321 (FIG. 10), and then enters the first insulation displacement slot 311 (FIG. 9). The insulation displacement slots 321, 311 have at least one part that is narrower than the overall electrical conductor 200 such that the insulation sheath layer 202 is displaced and the conductive core 204 makes electrical contact with the conductive IDC element.

When the cap 106 entirely closes, the resilient latch 188 (FIG. 4) flexes so that the latch projection 190 can engage with the latch opening 146 on the front wall 131 of the housing 130. The electrical conductor 200 extends proximally out of the housing 130 at the first wire groove 140 (FIG. 4), rests on the first support 163, and extends distally at 200*a*. When the cap is closed, the first wire stuffer 180 has entirely pressed and followed the electrical conductor 200 into the first insulation displacement slot 311 of the first contact 302 and the second insulation displacement slot 321 of the second contact 303 (FIG. 8A).

The electrical conductors 200, 206 include distal portions 200*a*, 206*a*, respectively, both of which are electrically connected to the first IDC element 300. The first recess 174 passes entirely through the cap 106, and the distal portions 200*a*, 206*a* of the electrical conductors 200, 206*a* are available for connection to a further portion of the electrical system.

The first and second recesses 174, 176 on the underside of the cap 106, may be generally circular (FIG. 3). However, as can be seen in FIGS. 1, 2, 4, and 5-7, ends 174*a* and 176*a* of the first and second recesses 174, 176 visible on a top surface of the cap 106 have an oval shape. The oval shape allows movement of portions 200*a*, 206*a* of wires 200, 206, respectively, and thus avoids sharp bends in the wires 200, 206 as they exit the cap 106.

When the cap 106 is closed, the cap 106 may entirely seal the housing 130. Additionally, a gel or other sealant material may be added to the housing 130 prior to the closure of the cap 106 to create a moisture seal within the housing 130 when the cap 106 is closed. Sealant materials useful in this invention include greases and gels. One suitable sealant material is a general purpose silicone dielectric gel available under the trade name RTV 6166, from GE Silicones, Wilton, Conn., although other suitable greases and gels are also acceptable.

When the cap 106 is closed, the user cannot visually see if the wires 200, 206 are properly in place within the first IDC element 300. However, the user is able to verify that the proximal portions of the electrical conductors 200, 206 are properly entering through the first wire groove 140, and that the distal ends 200*a*, 206*a* also properly extend from the housing 130. With the ability to verify that each end of the electrical conductors 200, 206 has been properly placed, the user can interpolate that the middle of the electrical conductors 200, 206 has been properly aligned and inserted into the IDC element.

The positioning of the height from the base 134 of the housing 130 relative to the first IDC element 300 and the second IDC element 301 all assist in reducing the forces necessary for making the electrical connection between the electrical conductors 200, 206 and the IDC elements 300, 301. The positioning and length of the first wire stuffer 180 and second wire stuffer 184 may also be manipulated to assist in reducing the forces necessary for closing the cap 106 and making the electrical connections. The present invention effectively allows for a distribution of the forces necessary for electrically coupling the electrical conductor to the IDC element through the use of a pivoting cap, without the use of special closure tools by effectively sequencing the alignment and insertion of the electrical conductor into the contacts.

When electrical conductors are positioned in both the first section 135 and the second section 137 of the housing 130, closing of the cap enables the wire stuffers to sequentially stuff the electrical conductors into the first and second contacts of the second IDC element 301, and then stuff the electrical conductors into the first and second contacts of the first IDC element 300. Because of the curved shape of the closing cap and the staggering of the IDC elements, the stuffing of the wires into the IDC elements does not occur all at once, but rather sequentially, further reducing the ultimate closure force. After the electrical conductors are in place, the cap is snapped shut. Because the stuffing and closing of the cap do not occur at the same time, the force required by the user is reduced. Varying the height of the IDC elements with respect to one another or varying the lengths of the wire stuffers with respect to one another will also result in a beneficial sequential insertion of the electrical conductor in the contacts.

Two wires/electrical conductor 200, 206 enter the first section 135 of the housing 130. In this regard, a second electrical conductor 206 (FIG. 4) is inserted on top of the electrical conductor 200. It is preferable that the first electrical conductor 200 be entirely inserted first and then the cap 106 opened to receive the second electrical conductor 206. The second electrical conductor 206 would be inserted just as the first electrical conductor 200 was inserted as described above and shown in FIGS. 5-7. There may be instances where both electrical conductors may be inserted at once. The insertion of the electrical conductor 200 has been discussed with respect to only the first section 135 of the housing. However, it is understood that insertion of wires into the second section 137 occurs in a similar manner. Further description of the insertion of two electrical conductors is described in U.S. Patent Application Publication US2006/0057883, titled "INSULATION DISPLACEMENT SYSTEM FOR TWO ELECTRICAL CONDUCTORS" filed on Sep. 15, 2004, the disclosure of which is hereby incorporated by reference.

FIG. 8A illustrates a perspective view of an insulation displacement element 300 according to one embodiment of the present invention. The first IDC element 300 includes the first contact 302, the second contact 303, a bridging section 304 electrically connecting contacts 302 and 303, and a resilient tail 305 extending below and biased from the bridging section 304. In one embodiment, resilient tail 305 terminates in a tail end 306 suitable for soldering to circuits in general.

When the first IDC element 300 is placed in the first section 135 of the housing 130, the tail 305 extends through the base unit 102 and the tail end 306 is brought into contact with a printed circuit, for example. Tail 305 includes solder tails, as best illustrated in FIG. 8A, configured for soldering to a printed circuit. Alternatively, tail 305 includes a compliant pin, as best illustrated in FIG. 8B, that is configured for a push-fit connection to a printed circuit (FIG. 12).

FIG. 8B illustrates a perspective view of an insulation displacement element 400 according to another embodiment of the present invention. IDC element 400 includes a first contact 402, a second contact 403, a bridging section 404 electrically connecting contacts 402 and 403, and a resilient tail 405 extending below and biased from the bridging section 404. The resilient tail 405 is configured to be push-fit into electrical connection with a hole formed in a printed circuit or printed circuit board.

With reference to FIG. 8A and FIG. 9, the first contact 302 (FIG. 9) has a generally U-shape, including a first leg 307 and a second leg 309 spaced from one another to form a first insulation displacement slot 311. The first insulation displacement slot 311 has a wide portion 312 and a narrow portion 314. At the wide portion 312 the first leg 307 and the second leg 309 are spaced farther from one another than at the narrow portion 314. For the first contact 302, the wide portion 312 is located adjacent the open end of the first insulation displacement slot 311, while the narrow portion 314 is located intermediate the wide portion 312 and the closed end of the first insulation displacement slot 311.

The second contact 303 (FIG. 10) also has a generally U-shape similar to the first contact 302, including a first leg 317 and a second leg 319 spaced from one another to form a second insulation displacement slot 321. The second insulation displacement slot 321 has a wide portion 324 and a narrow portion 322. However, the wide portion 324 of the second insulation displacement slot 321 is opposite to the wide portion 312 of the first insulation displacement slot 311. At the wide portion 324 the first leg 317 and the second leg 319 are spaced farther from one another than at the narrow portion 322. For the second contact 303, the narrow portion 322 is located adjacent the open end of the second insulation displacement slot 321, while the wide portion 324 is located intermediate the narrow portion 322 and the closed end of the second insulation displacement slot 321.

At the narrow portion 314 of the first contact 302, the first leg 307 and second leg 309 displace the insulation sheath 202 covering the first electrical conductor 200 so that the conductive core 204 makes electrical contact with the legs 307, 309. At the narrow portion 322 of the second contact 303, the first leg 317 and second leg 319 displace the insulation sheath 208 covering the second electrical conductor 206 so that the conductive core 210 makes electrical contact with the legs 317, 319. Therefore, the first and second electrical conductors 200, 206 are electrically connected to the first IDC element 300, and are electrically connected to one another.

The second IDC element 301 may be configured with first and second contacts having wide portions and narrow portions. The wide portion and narrow portions may be configured in reverse order, relative to the first IDC element 300 described above.

With regard to FIG. 8B, and in a manner similar to IDC element 300 above, the IDC element 400 provides the first contact 402 having a general U-shape, including a first leg 407 and a second leg 409 spaced from one another to form a first insulation displacement slot 411. The first insulation displacement slot 411 has a wide portion 412 and a narrow portion 414. Along the wide portion 412 the first leg 407 and the second leg 409 are spaced generally farther from one another than along the narrow portion 414. In this regard, with respect to the first contact 402, the wide portion 412 is located adjacent an open end of the first insulation displacement slot 411, while the narrow portion 414 is located intermediate the wide portion 412 and a closed end of the first insulation displacement slot 411.

With the above orientation of the first contact 402 in mind, the second contact 403 also has a generally U-shape. However, a wide portion of the second insulation displacement slot 421 is oriented to be opposite of the wide portion 412 of the first insulation displacement 411. That is to say, the wide portion 412 of the first contact 402 is aligned with a narrow portion of the second contact 403.

Although the IDC element 300 is shown having a first contact 302 and a second contact 303, it is understood that the IDC element may be an IDC element with just one contact. Also, the IDC element of the present invention may or may not have the wide portion and narrow portion described with respect to the IDC element shown in FIGS. 9 and 10. Further description of various insulation displacement connector elements and combinations thereof for use with the housing of the present invention is described in U.S. Patent Application Publication US2006/0057883, titled "INSULATION DISPLACEMENT SYSTEM FOR TWO ELECTRICAL CONDUCTORS" filed on Sep. 15, 2004, the disclosure of which is hereby incorporated by reference.

Any standard insulated jumper wire, such as a telephone insulated jumper wire, may be used as the electrical conductor. The wires may be, but are not limited to: 22 AWG (round tinned copper wire nominal diameter 0.025 inches (0.65 mm) with nominal insulation thickness of 0.0093 inches (0.023 mm)); 24 AWG (rounded tinned copper wire nominal diameter 0.020 inches (0.5 mm) with nominal insulation thickness of 0.010 inches (0.025 mm); 26 AWG (rounded tinned copper wire nominal diameter 0.016 inches (0.4 mm) with nominal insulation thickness of 0.010 inches (0.025 mm). The insulation can include any suitable electrically insulating material. Examples of suitable insulation materials include polymers in general, including polyolefins, and polyvinylchloride (PVC), polyethylene (PE), or polypropylene (PP) in particular.

FIG. 11 illustrates a perspective view through the connector assembly 100 of FIG. 1 (shown in phantom) showing insulation displacement element 300 soldered to a printed circuit 500 according to one embodiment of the present invention. The first IDC element 300 is positioned in the connector unit 104 with the tail 305 extending through the base unit 102 (not shown). In this regard, the tail end 306 has been soldered to a surface 502 of the printed circuit 500 by a solder bump 504.

In one embodiment, multiple IDC elements 300 are aligned with and electrically connected to multiple solder bumps 504 oriented in a desired configuration along the surface 502 of the printed circuit 500. For example, in one embodiment an array of solder bumps 504 printed on the surface 502 are brought into contact with multiple tails 305 extending from IDC elements 300. The solder bumps 504 are heated in a reflow solder process to flow the solder around the tails 305. A subsequent cooling process electrically and mechanically couples the tails 305 to the surface 502 of the printed circuit 500. In another embodiment, an individual tail end 306 is moved into proximity with the surface 502, and an individual solder bump 504 is dispensed (for example by a solder wire/solder gun) to form an electrical contact between the tail end 306 and the surface 502.

FIG. 12 illustrates a perspective view through the connector assembly 100 of FIG. 1 (shown in phantom) showing insulation displacement element 400 press fitted into a printed circuit 600 according to one embodiment of the present invention. In one embodiment, the printed circuit 600 includes a surface 602 that defines a hole 604. It is to be understood that the surface 602 would generally define multiple holes 604 oriented in a matrix (or in an array) that are suited for electrical connection to IDC elements 400. In this regard, one exemplary hole 604 is illustrated in cross-sectional view receiving the compliant pin 405 of the IDC element 400.

In one embodiment, the connector assembly 100 including the IDC element 400 is brought into proximity with the printed circuit 600, and the compliant pin 405 is press fitted into the hole 604. In one embodiment, multiple IDC elements 400 are provided in rows along the connector unit 104, and the compliant pins 405 of the rows of IDC elements 400 are press fitted into a corresponding row of holes 604 formed in the surface 602 of the printed circuit 600. In this manner, electrical connection between the IDC element 400 and the printed circuit 600 is achieved, and the wires 200, 206 (FIG. 4) electrically communicate with the printed circuit 600. The wires 200, 206 are thus available for electrical connection, or half-tapping, to other devices and circuits.

Embodiments of the present invention provide a housing enclosing one or more IDC elements where the IDC elements are configured for electrical connection to a printed circuit. The housing is configured to enable "4-wires in, 4-wires out" wiring where a pair of wires enters a front of the housing, electrically couples to one of the IDC element(s) and to the printed circuit, and the pair of wires exits a back of the housing. The wires exiting the housing are useful in electrically connecting other devices and other circuits to the printed circuit. The housing includes one or more caps that can be closed onto the housing, with the closing of the caps contributing to pressing the wires into electrical contact with the IDC elements. In this regard, the housing and the caps are configured to distribute the closing forces, thereby minimizing the force employed in snapping the cap shut onto the housing.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An electrical connector for terminating electrical conductors comprising:

a housing including:

a front wall spaced apart from a base;

first and second housing sections extending between the front wall and the base;

first and second wire grooves formed through the front wall;

first and second insulation displacement connector (IDC) elements disposed in the first and second housing sections between the first and second wire grooves and the base and configured for attachment to a printed circuit, wherein the first IDC element is closer to the front wall relative to the second IDC element; and a cap including a pivot portion pivotally mounted to the housing and a cover portion extending from the pivot portion, the pivot portion defining first and second wire receiving recesses that extend between an interior surface and an exterior surface of the cap, at least one guide disposed on the interior surface of the cap and at least one projection disposed on the interior surface of the cap adjacent to the at least one guide and aligned with an insulation displacement slot within the first IDC element;

wherein the cap is rotatable between an open position in which the first and second wire receiving recesses are linearly aligned with the first and second wire grooves, and a closed position in which the guide is configured to align a wire with the first IDC element and a wire cavity, the at least one projection is configured to urge the wire into the insulation displacement slot, the first wire receiving recess is substantially perpendicular to the first wire groove, and the cover portion is coupled to the front wall and the pivot portion is offset from the base to define the wire cavity between the pivot portion and the base.

2. The electrical connector of claim 1 in combination with a first pair of wires, wherein each wire is received by the first wire groove, engaged with the first IDC element, restrained within the wire cavity, and continues electrically uninterrupted through the first recess and the wire cavity when the cap is in the closed position.

3. The electrical connector of claim 1, wherein each of the IDC elements comprises:

a first contact and a second contact;

a bridge electrically coupling the first contact to the second contact; and a tail extending from the bridge away from the first and second contacts, the tail configured for electrical connection to the printed circuit.

4. The electrical connector of claim 3, wherein the tail is configured for electrical connection by one of soldering and press fitting to the printed circuit.

5. The electrical connector of claim 4, wherein the tail is a solder tail configured for soldering to the printed circuit.

6. The electrical connector of claim 4, wherein the tail terminates in a pin that is configured for soldering to a ball grid array of the printed circuit.

7. The electrical connector of claim 4, wherein the tail comprises a compliant pin that is configured for press fitting into an opening of the printed circuit.

8. The electrical connector of claim 2 in combination with a second pair of wires, wherein each of the wires in the second pair of wires is received by the second wire groove, engaged with the second DC element, restrained within the wire cavity, and continues electrically uninterrupted through the second wire receiving recess formed in the pivot portion of the cap and the wire cavity when the cap is in the closed position.

9. The electrical connector of claim 8, wherein the housing is characterized by the absence of a wire cutting blade such that the first pair of wires and the second pair of wires define four wires entering the housing and four electrically continuous wires exiting the housing through the cap.

* * * * *